US007092664B2

(12) United States Patent
Bartscher et al.

(10) Patent No.: US 7,092,664 B2
(45) Date of Patent: Aug. 15, 2006

(54) DIGITAL PRINTING OR COPYING MACHINE

(75) Inventors: Gerhard Bartscher, Köln (DE); Knut Behnke, Kiel (DE); Dirk Dobrindt, Klausdorf/Schwentine (DE); Gerald Erik Hauptmann, Bammental (DE); Hans-Otto Krause, Eckernförde (DE); Frank-Michael Morgenweck, Molfsee (DE); Kai-Uwe Preissig, Dortmund (DE); Domingo Rohde, Kiel (DE); Detlef Schulze-Hagenest, Molfsee (DE); Peter-Alexander Püschner, Schwanewede (DE)

(73) Assignee: Eastman Kodak Company, Rochester, NY (US)

( * ) Notice: Subject to any disclaimer, the term of this patent is extended or adjusted under 35 U.S.C. 154(b) by 899 days.

(21) Appl. No.: 10/016,335

(22) Filed: Dec. 10, 2001

(65) Prior Publication Data

US 2002/0191993 A1 Dec. 19, 2002

(30) Foreign Application Priority Data

Dec. 22, 2000 (DE) ..... 100 64 583
Sep. 7, 2001 (DE) ..... 101 43 988

(51) Int. Cl.
*G03G 15/20* (2006.01)

(52) U.S. Cl. ..... 399/320; 399/336

(58) Field of Classification Search ..... 399/92, 399/335–338, 320

See application file for complete search history.

(56) References Cited

U.S. PATENT DOCUMENTS

| | | | | |
|---|---|---|---|---|
| 4,959,693 | A | 9/1990 | Mitsuya et al. | 355/290 |
| 5,983,063 | A | 11/1999 | De Niel et al. | 399/335 |

FOREIGN PATENT DOCUMENTS

| | | | |
|---|---|---|---|
| DE | 70 27 581 | U1 | 12/1970 |
| DE | 38 38 021 | A1 | 6/1989 |
| DE | 38 38 021 | C2 | 6/1989 |
| EP | 05 86 007 | A1 | 3/1994 |
| EP | 08 64 994 | A1 | 9/1998 |
| EP | 08 67 786 | A1 | 9/1998 |
| JP | 57130074 | A * | 8/1982 |
| JP | 11202738 | A * | 7/1999 |

OTHER PUBLICATIONS

International Search Report.

* cited by examiner

*Primary Examiner*—Arthur T. Grimley
*Assistant Examiner*—Ryan Gleitz
(74) *Attorney, Agent, or Firm*—Lawrence P. Kessler

(57) ABSTRACT

A digital printing or copying machine (1) is proposed for the one-sided or double-sided printing onto a substrate (5), using at least one toner. The machine (1) includes at least one fixation device (3) for fixing the toner image on the substrate (5). The fixation device (3) has at least one heating device (13) for melting the toner image, past which the substrate (5) can be taken. The machine (1) is distinguished by a guide device (17) for the free floating movement of the substrate (5) in the effective range of the heating device (13).

16 Claims, 6 Drawing Sheets

DIGITAL PRINTING OR COPYING MACHINE

FIELD OF THE INVENTION

The invention concerns a digital printing or copying machine for one-sided or double-sided printing on a substrate while using at least one toner.

BACKGROUND OF THE INVENTION

Digital printing or copying machines work, for example, by the electrophotographic process, in which a latent electrostatic image is developed by charged toner particles. These are transferred to an image receiver substrate, hereinafter, the substrate. Thereafter, the image that has been developed and transferred to the substrate is fixed by heating and melting the toner particles. Contact methods are often used to melt the toner particles, during which the toner particles are brought into touching contact with corresponding devices, such as hot rolls or rollers. The drawback is that the use of silicone oil as separating agent is generally required to prevent a sticking of the melted toner to the heating device. Furthermore, the construction, the maintenance, and the operating costs of these touch type heating devices are substantial and, thus, cost intensive. Moreover, the error rate produced by the contact heating devices is relatively high. Furthermore, noncontact heating devices and methods are known for fixing the toner that has been transferred to paper (for example), in which the toner particles are melted, for example, by heat from thermal/microwave radiation or by hot air.

The contact and the noncontact melting methods use, for example, a toner whose glass transition temperature ($T_G$) lies in a range of 45° C. to 75° C. The glass transition temperature, in which the toner starting from the solid state begins to become soft, can be influenced by the choice of the raw materials and by adding certain additives to the toner. In a fixation device having at least one heating device for the toner, both the toner and the substrate itself is heated. In order to make sure of a good fixation of the toner on the substrate, the surface temperature of the substrate must be in the region of the glass transition temperature of the toner or higher. The toner will reach or exceed the glass transition temperature ($T_G$) already in the region of the heating device.

There are familiar printing and copying machines in which the substrate is printed or coated on both sides, and either the very same image generating and transferring device and heating device are used for the printing on the front and back side, or a separate image generating and transferring device and heating device are used. In order to fix the toner image, the substrate is frequently taken by a transport belt, on which the substrate is placed, past the at least one image generating and transferring device and the corresponding heating device. In this case, a first toner image is initially transferred to a first substrate side and then fixed. After this, a second toner image is transferred and fixed on the second substrate side. Therefore, when melting the second toner image, the first substrate side with the already fixed first toner image located on it lies on the transport belt. The disadvantage here is that, during the melting of the second toner image, the first toner image can become heated to such an extent that it becomes soft and has a tendency to stick to the transport belt. This can lead to several undesirable effects: due to the sticking, a substrate jam can occur when taking the substrate from the transport belt to a subsequent part of the machine. Furthermore, the appearance of the toner image can change in the areas where it sticks to the transport belt. This results in problems of image quality, for example, the toner image has an irregular gloss.

SUMMARY OF THE INVENTION

The purpose of the invention is to specify a machine in which a two-sided printing on a substrate is possible with simultaneous high quality of the images or coatings placed on the front and back side of the substrate. To accomplish the purpose, a digital printing or copying machine is proposed, having at least one fixation device, which serves to fix a toner image that has been transferred to a substrate. The toner image can be monochromatic or multicolored. In connection with the present invention, by "toner image" is meant also a coating having at least one toner layer. The substrate can be, for example, a sheet or a continuous web, which consists of paper or carton, for example. In order to fix the liquid or dry toner on the substrate, it is taken past a heating device, which is part of the fixation device. The printing or copying machine according to the invention is distinguished by a guide device for free floating movement of the substrate in the effective range of the heating device. By "free floating" is meant that the substrate has no contact with any other surface, such as a transport belt, a support plate, or the like. If the substrate is being printed on both sides, it has a first toner image on one side (the underside), which is already fixed on the substrate, when a second toner image, which has been transferred to the other, second side of the substrate (the top side), is being melted by the heating device. In this process, the first toner image can be heated to the extent that it tends to cling/stick if it comes into contact with a surface. But since according to the invention the substrate is free floating as it moves during the melting process of the second toner image, at least until the first toner image has cooled down so much that it no longer has a tendency to stick to surfaces, a damaging or impairment of the quality of the first toner image can be ruled out. Therefore, it is possible to ensure a uniform image quality and a uniform gloss of the toner images on the front and back side of the substrate. It should be noted that the front side of the substrate depending on how it is viewed can form either the topside or the underside, that is, the first toner image can be located on the front side or the back side of the substrate. The same holds for the second toner image.

In one advantageous sample embodiment of the machine, it is specified that the floating condition of the substrate be achieved by at least one air cushion acting on the topside and/or underside of the substrate containing the toner image being fixed. An additional function of the air cushion can consist in cooling the substrate and, if necessary, a toner image already fixed on the substrate. For this purpose, the air used to generate the air cushion has a correspondingly low temperature. It is also possible to preheat the substrate at the same time by the air cushion. For this, appropriately warm or hot air will be placed on the substrate.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENTS

Figure 1:
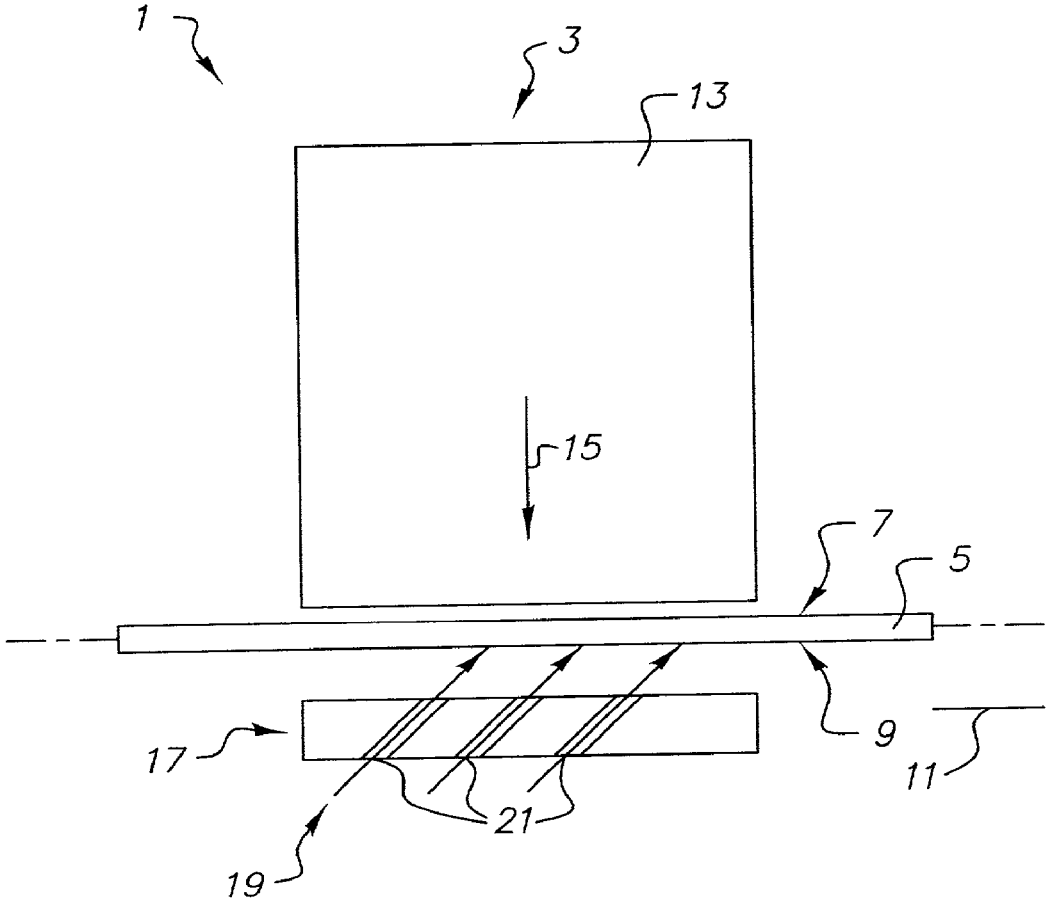
FIG. 1 is a portion of a sample embodiment of a fixation device with a first sample embodiment of the invented guiding device.

FIG. 1 shows a feature of a sample embodiment of a printing or copying machine 1, operating for example by the electrographic or electrophotographic process, namely, a fixation device 3, which is used to fix a toner image which has been transferred to a substrate 5. The toner image being fixed is located here on the topside 7 of the substrate 5, i.e., opposite the fixation device 3. On the underside 9 of the substrate 5 there can be another toner image, one already fixed on the substrate 5. The transport path of the substrate 5 in this sample embodiment runs parallel to an imaginary horizontal line H. The transport direction 11 of the substrate 5 is indicated by an arrow.

The fixation device 3 has a heating device 13 for melting the toner image onto the substrate topside 7, which in this sample embodiment throws hot air onto the substrate 5. The air flow 15 indicated by an arrow impinges essentially perpendicularly on the substrate topside 7.

The machine 1, furthermore, comprises a guide device 17 for the substrate 5, which serves to guide the substrate 5, free floating, at least in the effective range of the heating device 13, that is, the guide device 17 prevents the substrate's underside 9 from making contact with a surface while the toner image located on the substrate's topside 7 is being melted. The guide device 17 here has a first blowing device 19 (not represented more precisely), which comprises several nozzles which can be directed against the substrate underside 9 to expose the substrate to air under an excess pressure. The air jets 21 emerging from the nozzles, shown by arrows, impinge on the substrate underside 9 at an angle other than 90°. The orientation of the air jets 21 here is chosen such that they each have one directional component perpendicular to the substrate underside 9 and one directional component relatively parallel to the transport direction 11 of the substrate 5. The air jets 21 have the effect of forming an air cushion between the substrate underside 9 and a wall 23, which prevents the substrate underside 9 from making contact with the wall 23, for example, a perforated plate having the nozzles. Since the air jets 21 are also pointed in the transport direction 11, the air stream serving to generate the air cushion also contributes somewhat to the movement of the substrate 5 in the transport direction 11. The air stream 15 placed by the heating device 13 on the substrate topside 7 and the air stream generated by the first blowing device 19 on the opposite side of the substrate are attuned to each other so that the substrate 5 exists in a floating state in the effective range of the heating device 13, i.e., it has neither contact with the heating device 13 nor with the wall 23 situated underneath the transport plane. A suitable control unit, not represented in the Figures, controls the position of the substrate 5 between the heating device 13 and the wall 23, as well as the transport speed of the substrate, by appropriately adjusting in particular the air stream 15 and the air stream generated by the first blowing device 19. The distance of the substrate from the heating device and from the wall 23 is likewise adjustable. Such a control unit can also be provided in the following sample embodiments, in which the substrate is impinged upon by one air stream or several air streams.

Figure 2:
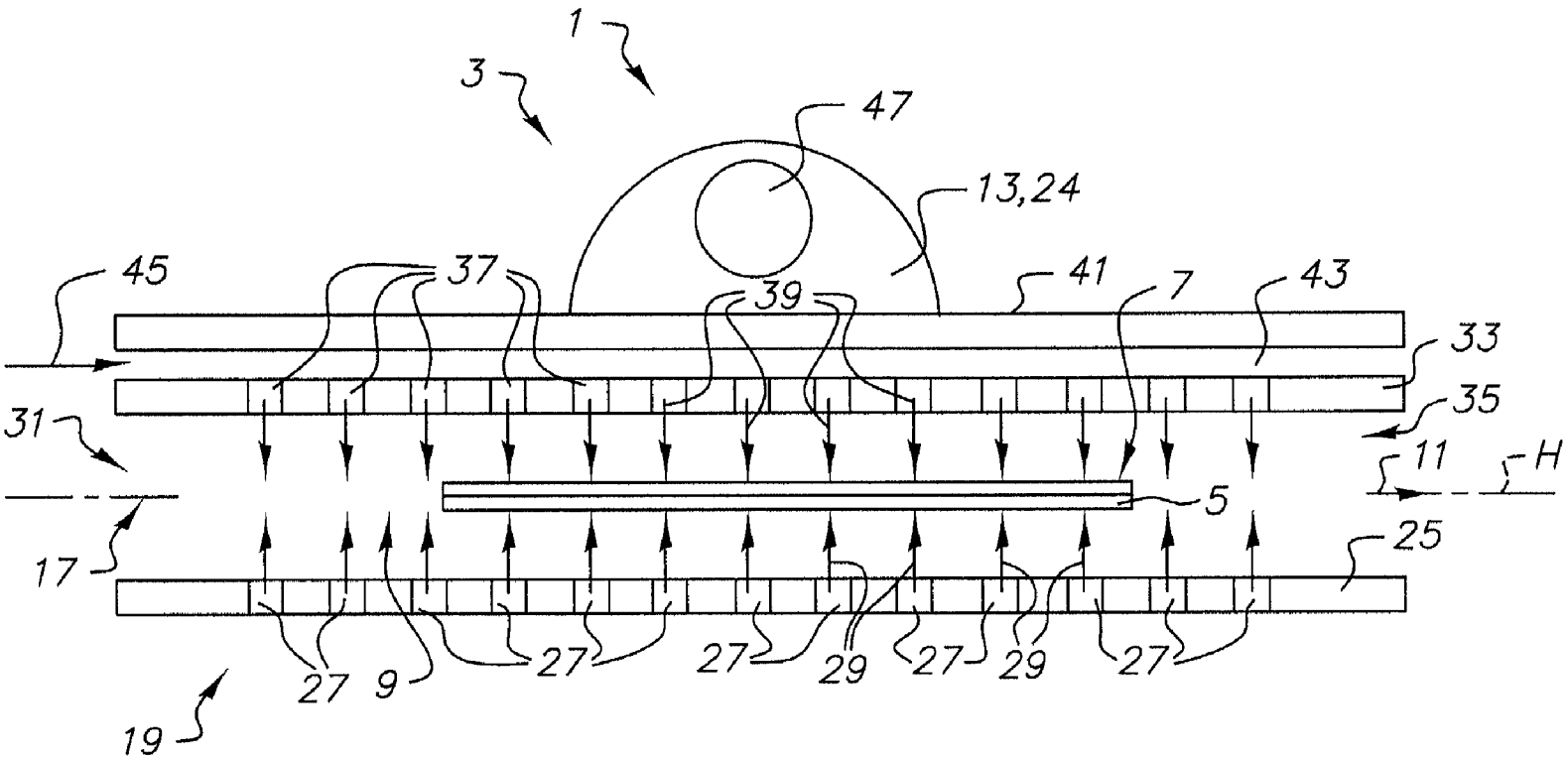
FIG. 2 is a second sample embodiment of the guiding device.

FIG. 2 shows a segment of another sample embodiment of the fixation device 3 and the guide device 17. The heating device 13 of the fixation device 3 is formed here by a radiative device 24, by which the substrate 5 is exposed to electromagnetic radiation. The guide device 17 includes a first blowing device 19 (not represented more precisely), which is arranged underneath the transport pathway of the substrate. The first blowing device 19 has a first base plate 25 directed in parallel with the transport path of the substrate, in which a number of through openings 27 are made. The through openings 27 are connected to a pressurized air supply unit (not represented) at their side of the base plate 25 away from the transport path, so that an air jet 29 can be applied to the substrate underside 9 via the through openings 27, which act as nozzles, thereby creating an air cushion, which prevents the substrate from coming into contact with the first base plate 25.

The guide device 17 represented in FIG. 2, moreover, has a second blowing device 31 which serves to create an air cushion between the substrate's topside 7, having the toner image which is being fixed, and a second base plate 33, which is part of the second blowing device 31. The second base plate 33 is arranged above the transport path of the substrate 5 at a distance from the first base plate 25 and parallel with it. The transport path of the substrate thus runs here in the free space 35 between the base plates 25, 33. The second base plate 33 likewise has through openings 37 serving as nozzles, which are connected to a pressurized air supply unit (not represented) on their side away from the free space 35, so that an air jet 39 can be applied perpendicularly to the substrate's topside 7 via each of the through openings 37.

At the side of the second base plate 33 turned away from the free space 35, at a distance from it, there is arranged a protection plate 41, which runs parallel to the second base plate 33. The relatively thin protection plate 41, which can be formed by a foil, for example, has no through openings, so that when pressurized air is applied to the intermediate space 43 between the second base plate 33 and the protection plate 41 as indicated by an arrow 45 the pressurized air gets through the through openings 37 to create an air cushion between the second base plate 33 and the substrate's topside 7.

The second base plate 33 and the protection plate 41 are made from a material transmissible to radiation and as can be seen from FIG. 2 they are arranged in the path of the radiation between the radiative device 24 and the substrate 5. In one advantageous sample embodiment, the radiative device 24 emits UV radiation or near infrared radiation in the direction of the substrate 5 when the radiator 47 is turned on. The protection plate 41 and the second base plate 33 let through up to 95% of the radiated power put out by the radiative device 24 when the latter is turned on, so that the toner image located on the substrate 5 is melted in desired manner. If a malfunction should occur, such as a stoppage of the substrate transport, the radiative device 24 will be switched off, which is preferably done automatically. The radiative device 24 then no longer emits any UV or near infrared radiation, but instead only the thermal radiation of the parts, which have become heated when the radiative device 24 is turned on. The radiative device 24 then emits only still in the infrared spectrum. After switching off the radiative device 24, the wavelength of the emitted radiation changes with the existing temperature of the switched off radiator 47, namely, it then lies above roughly 3.4 μm or more. This radiation spectrum, however, is almost totally absorbed by the protective plate 41 and the second base plate 33, so that when the radiative device 24 is switched off only around 10% of the initial energy of the residual thermal radiation will reach the substrate 5. The majority of the residual thermal radiation is preferably absorbed by the protective plate 41, which lies opposite the radiative device 24, so that it has a distinctly higher temperature than the second base plate 33, which lies opposite the transport plane of the substrate. In any case, the heating of the second base plate 33 is only high enough that, if a contact should occur between the substrate 5 and the second base plate 33, the substrate 5 will not be ignited. Thus, the second base plate 33 also serves as a stopping point for the substrate 5, so that it can never come into contact with the radiative device 24. Thus, while the protection plate 41 serves only as a filter for a particular spectrum of electromagnetic radiation, the second base plate 33 has several functions, namely, a stopping point for the substrate 5, a filter for the residual thermal radiation, and a device to accommodate the nozzles of the second blowing device 31.

The second base plate 33 is preferably cooled down by the pressurized air flow within the intermediate space 43, which is established when the blowing device 31 is activated, so that it is not heated above a critical temperature at which the substrate 5 would ignite in event of a touching contact between it and the second base plate 33.

In order to maintain the substrate 5 in a floating condition in the effective range of the radiative device 24, as depicted in FIG. 2, the application of pressurized air to the topside 7 and that to the underside 9 of the substrate 5 by the blowing devices 19 and 31 are appropriately attuned to each other. Thus, while the toner image on the substrate topside 7 is melted without contact by application of electromagnetic radiation, the substrate 5 is supported by the air cushion created on its underside by means of the first blowing device 19, and the air jets 39 prevent the substrate from hitting the base plate 33.

Figure 3:
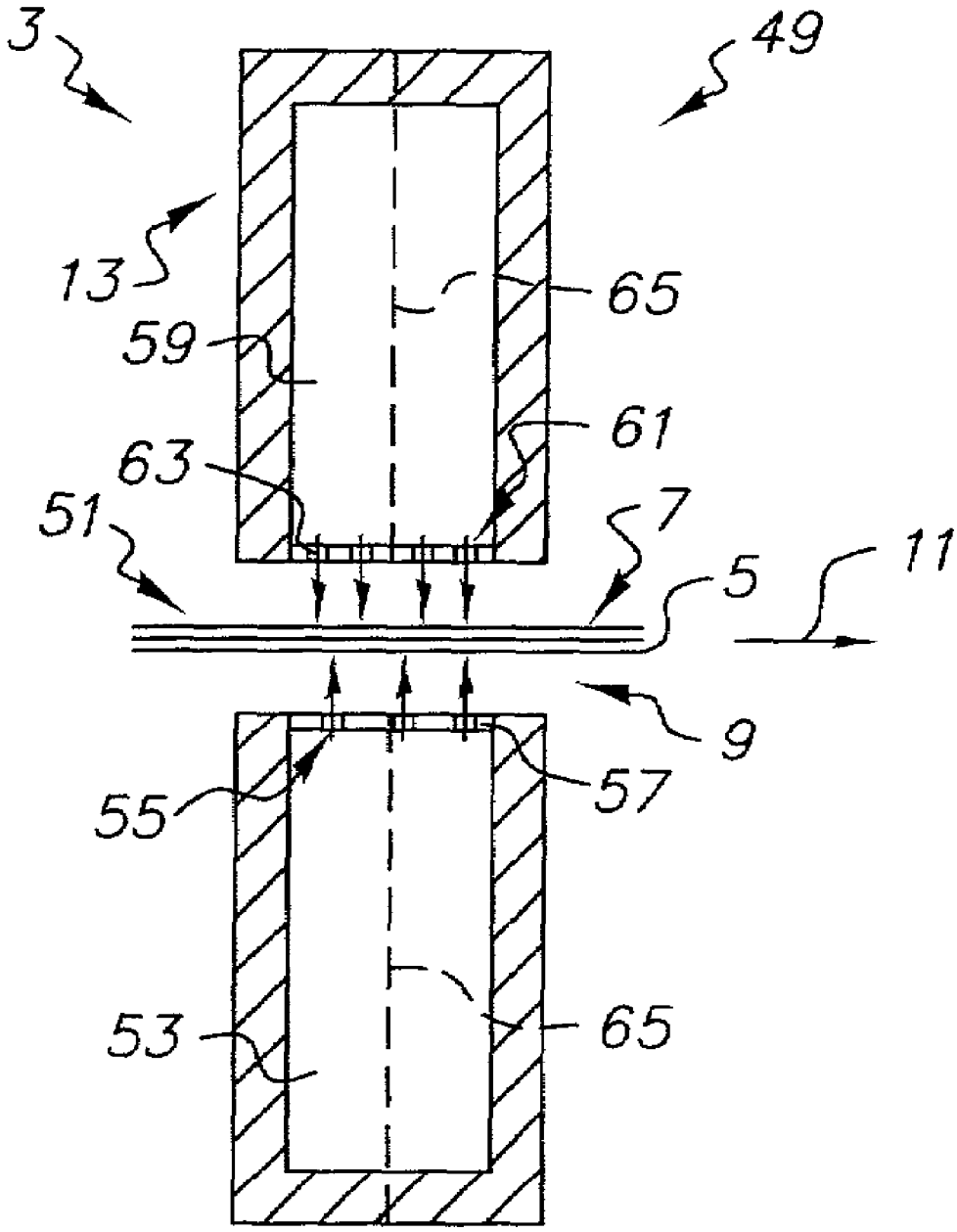
FIG. 3 is a side view of a sample embodiment of a heating device.

FIG. 3 shows another sample embodiment of the fixation device 3, namely, a heating device 13, which includes a microwave resonator 49. This has a slit-like opening 51, through which the substrate 5 is guided in the direction of transport 11. There is a first pressure chamber 53 integrated into the portion of the microwave resonator 49 lying underneath the transport path of the substrate 5, which extends transversely across the width of the substrate's transport path and has an opening 55 facing the substrate's transport path, which is covered with a perforated plate 57. The perforated plate 57 has a number of through openings and/or slots that function as nozzles when pressure is applied from the first pressure chamber 53, as shall be discussed further below. The perforated plate 57 is made from a material with low microwave absorption, in order that the resulting heating be slight. The material is chosen so that, allowing for the cooling air flow, the temperature of the perforated plate is not more than 50° C. to 100° C. (depending on the melting temperature of the toner used). in this way, one can prevent toner dust from sticking to the perforated plate with the occasionally resulting clogging of holes. Examples of materials for the perforated plate are fluoropolymers, such as PVDF (polyvinylidene fluoride), or PTFE (polytetrafluorethylene), or technical grade ceramics like silicate ceramics, oxide ceramics (e.g., aluminum oxide), or nonoxide ceramics.

In the part of the microwave resonator 49 lying above the transport path of the substrate 5 there is integrated a second pressure chamber 59, which has an opening 61 facing the substrate transport path, being covered by a perforated plate 63, which is preferably made from the same material as the perforated plate 57. This has a number of through openings and/or slots which act as nozzles when exposed to pressure from the second pressure chamber 59 through a preferably gaseous medium. The first and second pressure chambers 53, 59, which can preferably be subjected to pressurized air, are connected either to a common supply source of pressurized air or each to a separate supply source of pressurized air. When the pressure chambers 53, 59 are subjected to pressurized air, an air jet is directed onto the topside 7 or underside 9 of the substrate 5 through the openings and possibly the slots in the perforated plates 57, 63, respectively. In this way, an air cushion is created on both the topside and underside of the substrate, which are attuned to each other so that the substrate 5 is taken free floating through the slitlike opening 51 in the microwave resonator 49 as represented in FIG. 3. Thus, the substrate 5 has no contact with the microwave resonator 49, while the toner image on the substrate topside 7 is melted by the microwave radiation from the resonator 49.

Therefore, sufficient pressurized air is applied to the substrate 5 by the first pressure chamber 53 and the perforated plate 57, so that it floats almost weightlessly above the lower part of the microwave resonator 49. The strength of the air cushion is adjusted so that the distance between the substrate 5 and the upper perforated plate 63 is at least so large that a jamming of the substrate inside the slit-like opening 51 is prevented. In this sample embodiment (as mentioned), a second pressure chamber 59 is provided in the upper part of the microwave resonator 49, by which a second air cushion can be created between the substrate topside 9 and the upper part of the microwave resonator 49. In this way, any contact between the substrate 5 and the perforated plate 63 can be virtually excluded. In a sample embodiment not represented in the FIGS., the second pressure chamber 59 is omitted and the free floating condition of the substrate 5 within the heating device 13 is accomplished entirely by the air cushion created by the first pressure chamber 52 on the underside 9 of the substrate 5.

The pressurized air applied to the substrate 5 by the pressure chambers 53, 59 can be preheated, which enhances the effectiveness of the heating device 13. It is possible to implement zones with differing temperature looking in the direction of transport 11 of the substrate 5. Preferably, in the entrance region of the substrate 5 into the opening 51, very hot air is applied to the substrate 5 by the pressure chambers 53, 59, which supports the melting of the toner image, while cooler pressurized air is applied to the substrate 5 in the exit region of the opening 51, in order to cool it. For this, the pressure chambers 53, 59 are each divided into at least two separate pressure chambers looking in the substrate transport direction 11 as indicated by the broken line 65.

In FIG. 3, the transport path of the substrate 5 runs parallel to the horizontal line H. In another sample embodiment, the transport path of the substrate 5 in the region of the microwave resonator 49 runs vertically, preferably from top to bottom following the force of gravity. For this, the microwave resonator 49 is similar or identical in construction to that of FIG. 3, i.e., it has first and second pressure chambers 53, 59, by which it is possible to avoid a contact between the substrate 5 and the walls of the opening 51 in the microwave resonator 49.

Figure 4:
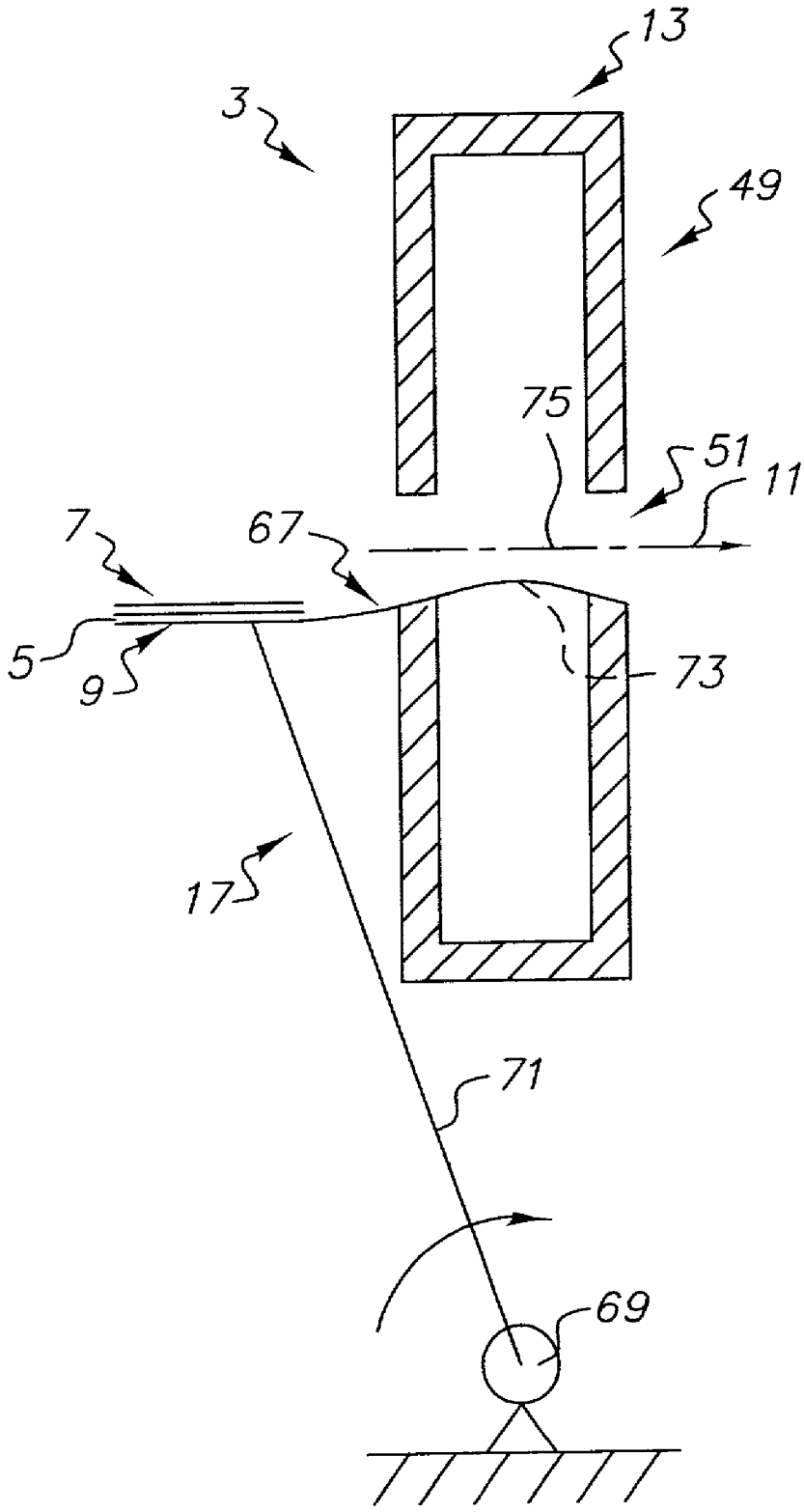
FIG. 4 is a side view of the heating device per FIG. 3 with another sample embodiment of the guiding device.

FIG. 4 shows another sample embodiment of the guide device 17, which here has a holding device 67 (not represented more precisely), by which the substrate 5 can be grabbed in the region of its front edge. By "grabbed" is meant that the holding device 67 holds the substrate 5 by friction and/or by form fitting. The holding device 67 here is arranged at the free end of at least one lever 71 which can pivot about an axis 69. The pivoting lever 71 is arranged near the microwave resonator looking in the transport direction of the substrate. The guide device 17 represented in FIG. 4 is combined with a heating device 13 of the fixation device 3, which is essentially identical in construction to that described by FIG. 3. One difference is that, although the microwave resonator 49 has recesses to configure the first and second pressure chambers 53, 59, these are not connected to a pressurized air supply unit. Thus, no air cushion(s) is created in the slit-like opening 51 of the microwave resonator 49 in the sample embodiment.

In the position of the pivoting lever 71 represented in FIG. 4, the front edge of the substrate 5, being carried from a portion of the machine arranged in front, to the heating device 13 is grabbed by the holding device 67. By a pivoting of the lever 71 in the clockwise direction about the axis 69, the substrate is carried along and follows the trajectory 73 of the holding device 67, which leads through the slit-like opening 51 in the microwave resonator 49. The substrate 5 is carried along in such a way that the substrate 5 has no mechanical contact with the microwave resonator 49 inside the opening 51. The broken line indicates the trajectory 75 of the substrate 5 inside the opening 51 of the microwave resonator 49. It should be noted that in this sample embodiment as well, the substrate 5 moves free floating in the effective range of the heating device 13, i.e., the microwave resonator 49.

Figure 5:
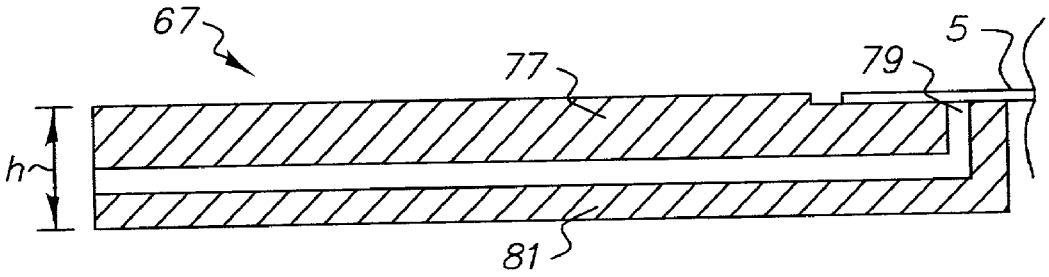
FIG. 5 is a lengthwise section through a sample embodiment of a strip, which is part of a holding device for a substrate.

FIG. 5 shows a lengthwise section through a sample embodiment of the holding device 67, which comprises a strip 77 that when installed extends transverse to the direction of substrate transport 11. The strip 77 has a slit-like opening 79, which is connected to a partial vacuum device via a connection channel 81. Thus, the grabbing of the substrate 5 here occurs in such a way that a partial vacuum is applied to the opening 79, which sucks the substrate 5 to the strip 77 and holds it there as shown in FIG. 5. The height h of the strip 77 is less than the height of the slit-like opening 51 in the microwave resonator 49, so that the strip 77 can be taken through the opening 51 without making contact.

In order for the holding device 67 to move according to a desired trajectory, instead of the at least one pivoting lever 71 there can also be a linkage, a crank and rocker mechanism, or a wheelwork or the like. The important thing is that the trajectory of the holding device 67 is chosen such that the substrate 5 has no contact with the microwave resonator 49 as it is transported through it. Of course, the embodiment of the guide device 17 described by means of FIGS. 4 and 5 can also be used in conjunction with a heating device, which applies electromagnetic radiation, hot air or the like to the substrate 5 in order to melt the toner image on it.

As an alternative, the holding device 67 can also have a grabbing device, by which the substrate 5 can be clamped.

In addition to or instead of the slit-like opening 79, the strip 77 can also have several suction openings formed by boreholes.

Figure 6:
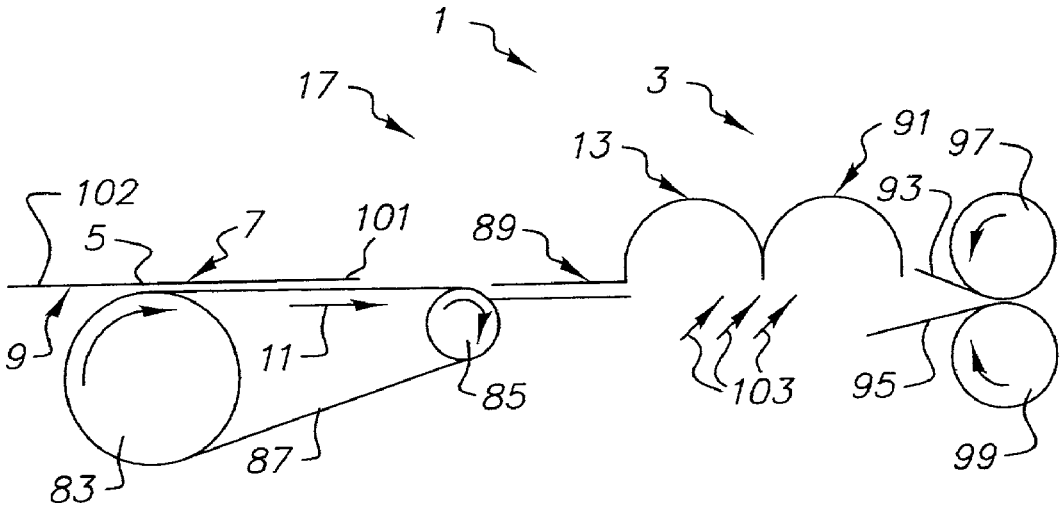
FIG. 6 is a feature from the sample embodiment of a printing or copying machine in the region of a fixation device.

FIG. 6 shows another sample embodiment of the machine 1, namely, a feature in the area of its fixation device 3. The same parts are given the same reference numbers, so that one can refer to the description of the preceding figures. The heating device 13 is combined with another sample embodiment of the invented guide device 17, which comprises an electrostatically charged transport belt 87 that is moved by rollers 83 and 85. This serves to take the substrate 5 up to the fixation device 13. In the gap between the roller 85, which serves to take the transport belt 17 back to the starting region of the transfer stretch, and the heating device 13, there is arranged a stationary guide element 89, formed here by a guide plate. The natural stiffness of the substrate 5 and/or the special shape of the electrostatic transport belt 87 and/or the special shape of the guide element 89 enable a straight transport of the substrate 5, without the substrate 5 buckling. The transport path of the substrate 5 here runs parallel to the horizontal.

The heating device 13 is followed looking in the direction of transport 11 of the substrate 5 by a cooling device 91, which serves to cool the substrate and the toner image located on it. The cooling device 91 is followed by another two guide elements 93 and 95, which lead the substrate 5 into a nip formed between two transport rollers 97 and 99.

Regarding the function of the guide device 17: the substrate 5 lying flat on the transport belt 87 is taken by a movement of the transport belt 87 in the transport direction 11 to the fixation area. In the region of the roller 85, the transport belt 87 is taken back to the start of the transfer stretch. The substrate 5 continues to move in the transport direction, so that its front edge 101 is pushed out beyond the roller 85. The substrate 5 is then pushed by the transport belt 87 underneath the heating device 13 and the cooling device 91 past them, until the front edge 101 of the substrate 5 ends up in the nip between the transport rollers 97, 99 and is grabbed by them and transported further. As can be seen from FIG. 6, the substrate 5 moves free floating in the region of the heating device 13 and the cooling device 91, that is, it has no contact with any surface, so that when the toner image located on the substrate topside 7 is melted by the heating device 13, one can rule out any impairment of the already fixed toner image located on the substrate's underside 9.

In order to support the substrate 5 in the area of the heating device 13 and the cooling device 91, so that it does not buckle, the substrate's underside 9 can be struck with pressurized air from underneath, by a blowing device (not shown), as indicated by arrows 103.

In the sample embodiment represented in FIG. 6, at the moment when the front edge 101 of the substrate 5 is grabbed by the transport rollers 97, 99, the back edge 102 of the substrate 5 is just losing contact with the transport belt 87. In a sample embodiment not depicted, the distance between the roller 85 and the gap between the transport rollers 97, 99 is larger than the substrate length. This means that the back edge 102 of the substrate 5 runs off from the transport belt 87 before the front edge 101 of the substrate 5 is grabbed by the transport rollers 97, 99. The air stream 103 that is blown onto the substrate 5 from underneath can serve here to transfer or introduce the substrate 5 into the narrowing gap between the guide elements 93, 95, as the air stream has at least one directional component in the transport direction 11. Regardless of how and by what the substrate 5 is taken past the heating device 13, it is provided in any case that at the moment when the toner image on the substrate 5 is being melted, the substrate has no surface contact with either its topside or its underside at least in this region. In preferred embodiment, the effective range/fixing range of the heating device 13 is very short looking in the transport direction 11 of the substrate preferably smaller than 20 cm, for example, 10 cm. For this, the heating device 13 must be configured such that it can transmit a very high energy density onto the substrate, so that it is possible to melt the toner image in desired manner on this short stretch. The heating device 13, for example, can be formed by a radiative device, which has at least one high intensity lamp, emitting primarily in the UV range.

Basically, any wavelength region of this UV lamp can be used for the melting. However, the UV range is preferred, because the toners which are used generally absorb the electromagnetic radiation in this spectrum very well and the intensity of the light sources is very high in this region. In the infrared region, the toner or toners of the toner image and the substrate absorb the radiation very well, but the light sources often do not have sufficient intensity in this region, or the light source, such as a $CO_2$ laser, is too expensive. The radiative device can also have a xenon flash lamp, for example, by which light pulses are applied to the toner image in order to melt it. In another embodiment of the heating device, it applies hot air to the toner image in order to melt it. However, it is very difficult to transmit enough energy in a short time (low effective range of the heating device). In order to improve the energy transmission, steam can also be mixed in with the hot air. In another variant embodiment of the heating device 13, it bombards the toner image with microwave radiation.

Figure 7:
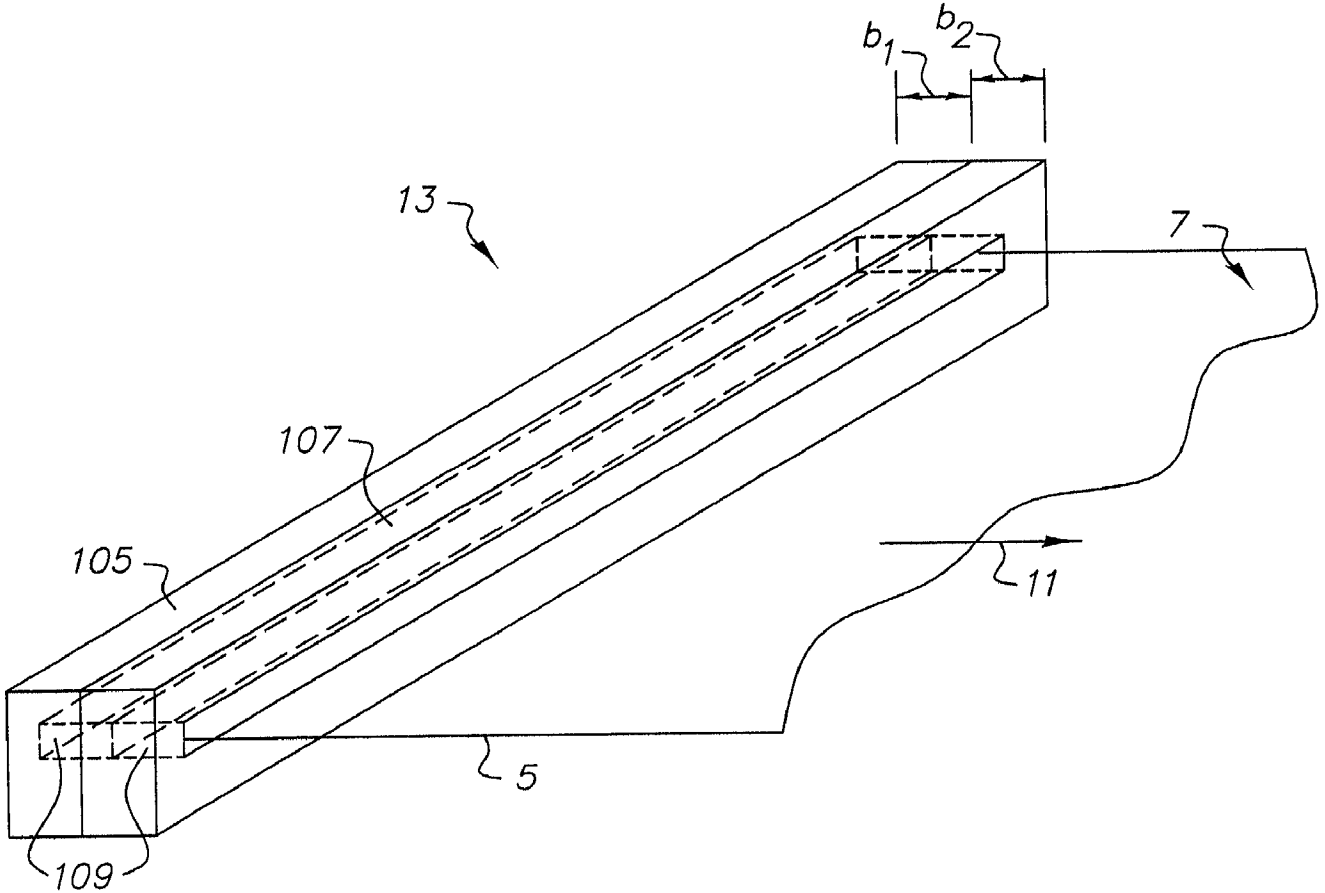
FIG. 7 is a perspective representation of another sample embodiment of the heating device.

FIG. 7 shows in perspective view a portion of a sample embodiment of the heating device 13 represented in FIG. 6. This comprises a first microwave resonator 105, which is followed directly by a second microwave resonator 107. These each have a slit-like opening 109, extending transverse to the transport direction 6 of the substrate, through which the substrate 5 is taken free floating as described by FIG. 3. As can be seen, the effective range of the microwave resonators 105, 107 looking down on the transport path of the substrate is very short or short. However, with such a heating device 13, a very high energy density can be transmitted to the substrate 5 without contact.

It should be noted that often one of the microwave resonators 105, 107 is sufficient to melt the toner image in the desired manner. Therefore, one can omit one of the two microwave resonators. In order to achieve a homogeneous heating with only one microwave resonator with a standing wave field, the standing wave field must oscillate periodically perpendicular to the direction of advancement/transport of the substrate in suitable fashion. The width $b_1$ of the microwave resonator 105 and the width $b_2$ of the microwave resonator 107 preferably lie in a range of 2 cm to 4 cm. The microwave resonators emit microwaves having a frequency of 2450 GHz, for example. The two microwave resonators serve to guarantee a homogeneous heating of the toner image. It should be noted that the guide device 17 described by FIG. 6 could also be used with a transport path of the substrate 5 running in the vertical direction. Preferably the transport direction is from top to bottom, i.e., following the force of gravity, which offers advantages in stabilizing the substrate 5, which consists of a flexible material. Furthermore, the movement of the substrate 5 is supported by gravity, or it can be brought about exclusively by gravity in the region of the fixation device 3.

The patent claims submitted with the application are proposed formulations, without detriment to the securing of a further patent protection. The applicant reserves the right to claim still other combinations of features, disclosed thus far only in the description and/or the drawings.

References used in subsidiary claims point to the further configuring of the object of the main claim with the features of the particular subsidiary claim; they are not to be taken as a renunciation of obtaining an independent, substantive protection for the combinations of features of the subsidiary claims thus referred.

The sample embodiments are not to be taken as a limitation of the invention. Rather, many changes and modifications are possible in the context of the present disclosure, in particular, such variants, elements and combinations and/or materials, which the practitioner can deduce with regard to the solution of the problem, for example, by combination or modification of individual features or elements or method steps that are contained in the drawings and described in conjunction with the general specification and forms of embodiment, as well as the claims, and which by combined features lead to a new object or to new method steps or sequences of method steps.

List of reference numbers

| | |
|---|---|
| 1 | Printing or copying machine |
| 3 | Fixation device |
| 5 | Substrate |
| 7 | Topside |
| 9 | Underside |
| 11 | Transport direction |
| 13 | Heating device |
| 15 | Air stream |
| 17 | Guide device |
| 19 | First blowing device |
| 21 | Air jets |
| 23 | Wall |
| 24 | Radiative device |
| 25 | First base plate |
| 27 | Through openings |
| 29 | Air jet |
| 31 | Second blowing device |
| 33 | Second base plate |
| 35 | Free space |
| 37 | Through openings |
| 39 | Air jet |
| 41 | Protection plate |
| 43 | Intermediate space |
| 45 | Arrow |
| 47 | Radiator |
| 49 | Microwave resonator |
| 51 | Opening |
| 53 | First pressure chamber |
| 55 | Opening |
| 57 | Perforated plate |
| 58 | Second pressure chamber |
| 61 | Opening |
| 63 | Perforated plate |
| 65 | Line |
| 67 | Holding device |
| 69 | Axis |
| 71 | Pivoting lever |
| 73 | Trajectory |
| 75 | Trajectory |
| 77 | Strip |
| 79 | Opening |
| 81 | Connection channel |
| 83 | Roller |
| 85 | Roller |
| 87 | Transport belt |
| 89 | Guide element |
| 91 | Cooling device |
| 93 | Guide element |
| 95 | Guide element |
| 97 | Transport roller |
| 99 | Transport roller |
| 101 | Front edge |
| 102 | Back edge |
| 103 | Pressurized air |

-continued

| | |
|---|---|
| 105 | Microwave resonator |
| 107 | Microwave resonator |
| 109 | Opening |
| | Special positions |
| H | Horizontal |
| h | Height |
| $b_1$ | width of resonator I |
| $b_2$ | width of resonator II |

What is claimed is:

1. Digital printing or copying machine (1) for one-sided or double-sided printing on a substrate (5) while using at least one toner, with at least one fixation device (3) for fixing the toner image on the substrate (5), wherein the fixation device (3) has at least one heating device (13) for melting the toner image, past which the substrate (5) can be taken, characterized by a guide device (17) for the free floating movement of the substrate (5) in the effective range of the heating device (13), said guide device (17) having a holding device (67) which can be moved in and against the transport direction (11) of the substrate (5) by which the substrate (5) can be grabbed in the region of its front edge or back edge.

2. Printing or copying machine per claim 1, characterized in that the floating condition of the substrate (5) can be achieved by at least one air cushion acting on the topside (7) having the toner image being fixed and/or the underside (9) of the substrate (5).

3. Printing or copying machine according to claim 1, characterized in that the guide device (17) has at least a first blowing device (19) to create a first air cushion on the substrate's underside (9), wherein the first blowing device (19) comprises at least one nozzle, which can be directed against the substrate underside (9), for applying pressurized air (21) to the substrate (5), the pressurized air (21) having at least one directional component directed perpendicular to the substrate underside (9) and one directional component directed in the transport direction (11) of the substrate (5).

4. Printing or copying machine according to claim 1, characterized in that the first blowing device (19) comprises a first base plate (25), oriented parallel to or essentially parallel to the transport path of the substrate (5), having several through openings and/or slots, each of which forms a nozzle.

5. Printing or copying machine according to claim 1, characterized in that the substrate topside (7) containing the toner being fixed can be struck with hot air (15) in order to melt the toner image by the heating device (13).

6. Printing or copying machine according to claim 3, characterized in that the guide device (17) comprises at least one second blowing device (31) to create a second air cushion on the topside (7) of the substrate (5), containing the toner image being fixed, and opposite the heating device (13).

7. Printing or copying machine according to claim 6, characterized in that the second blowing device (31) comprises at least one second base plate (33) oriented to or essentially parallel to the transport path of the substrate (5), having several through openings (37) and/or slots, each of them forming a nozzle.

8. Printing or copying machine according to claim 7, characterized in that the heating device (13) is formed by a radiative device (24), by which the substrate (5) can be exposed to electromagnetic radiation, and the second base plate (33) is arranged in the radiation path between the radiative device (24) and the substrate (5).

9. Printing or copying machine according to claim 8, characterized in that a protection plate (41) without through openings is arranged in the radiation path between the radiative device (24) and the second base plate (33).

10. Printing or copying machine according to claim 9, characterized in that the second base plate (33) and the protection plate (41) are formed of a transparent material which is permeable to the electromagnetic radiation emitted by the radiative device (24) in the switched on state.

11. Printing or copying machine according to claim 9, characterized in that the free space (43) between the protection plate (41) and the second base plate (33) can be exposed to pressurized air.

12. Printing or copying machine according to claim 1, characterized in that the heating device (13) comprises at least one microwave resonator (49), which has a slit-like opening (51), through which the substrate (5) is taken free floating, and in the microwave resonator (49) there is integrated at least one blowing device to create an air cushion on the topside and/or underside of the substrate (5).

13. Printing or copying machine according to claim 1, characterized in that the holding device (67) has a strip (77) extending transverse to the substrate's transport direction (11), which has at least one preferably slit-like opening (79), which can be exposed to a partial vacuum.

14. Printing or copying machine according to claim 12, characterized in that the slit-like opening (51) of the microwave resonator (49) is bounded by at least one perforated plate (57, 63).

15. Printing or copying machine according to claim 14, characterized in that the perforated plate (57, 63) is made from a material with low microwave absorption.

16. Printing or copying machine according to claim 1, characterized in that a cooling device with preferably non-contact operation with respect to the substrate is arranged after the heating device.

* * * * *